US006517770B1

(12) United States Patent
Tateishi et al.

(10) Patent No.: US 6,517,770 B1
(45) **Date of Patent: *Feb. 11, 2003**

(54) TEMPERATURE CONTROL DEVICE AND TEMPERATURE CONTROL METHOD FOR HIGH-TEMPERATURE EXHAUST GAS

(75) Inventors: Masataka Tateishi, Osaka (JP); Masahiko Tetsumoto, Osaka (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/819,850

(22) Filed: Mar. 29, 2001

(30) Foreign Application Priority Data

Mar. 30, 2000 (JP) ..... 2000-094110

(51) Int. Cl.[7] ..... B01D 47/06

(52) U.S. Cl. ..... 266/46; 261/115; 266/147; 75/381

(58) Field of Search ..... 266/46, 147; 261/115, 261/DIG. 9; 75/381

(56) References Cited

U.S. PATENT DOCUMENTS

| | | | |
|---|---|---|---|
| 5,989,019 A | 11/1999 | Nishimura et al. | |
| 6,063,156 A | 5/2000 | Negami et al. | |
| 6,129,777 A | 10/2000 | Fuji et al. | |
| 6,149,709 A | 11/2000 | Uragami et al. | |
| 6,152,983 A | 11/2000 | Kamijo et al. | |
| 6,241,803 B1 | 6/2001 | Fuji | |
| 6,251,161 B1 | 6/2001 | Tateishi et al. | |

FOREIGN PATENT DOCUMENTS

| | | | |
|---|---|---|---|
| DE | 38 02 718 | 8/1989 | |
| DE | 40 35 944 | 5/1992 | |
| EP | 0 538 972 | 4/1993 | |
| EP | 640373 A2 * | 3/1995 | ..... 266/115 |
| JP | 5-231633 | 9/1993 | |
| JP | 7-133919 | 5/1995 | |
| JP | 9-53129 | 2/1997 | |
| JP | 9-96411 | 4/1997 | |
| JP | 10-1724 | 1/1998 | |
| JP | 11-302750 | 11/1999 | |

* cited by examiner

*Primary Examiner*—Melvyn Andrews
(74) *Attorney, Agent, or Firm*—Oblon, Spivak, McClelland, Maier & Neustadt, P.C.

(57) ABSTRACT

In a temperature control device comprising a temperature control tower for controlling a blown high-temperature exhaust gas to a proper temperature and discharging the temperature-controlled exhaust gas to the subsequent step side, the temperature control tower comprises a cooling water spray means for spraying cooling water to about the center of the gas flow of the high-temperature exhaust gas and a cooling gas injecting means for injecting cooling gas along the inner wall of the temperature control tower.

21 Claims, 4 Drawing Sheets

TEMPERATURE CONTROL DEVICE AND TEMPERATURE CONTROL METHOD FOR HIGH-TEMPERATURE EXHAUST GAS

BACKGROUND OF THE INVENTION

1. Field of the Invention

This invention relates to a temperature control device for cooling high-temperature exhaust gas and a temperature control method for high-temperature exhaust gas.

2. Description of the Related Art

Temperature control devices are generally used to control the high-temperature exhaust gas discharged from a high-temperature gas generation source such as incinerator, melting furnace or the like to a temperature suitable for the treatment with a bag filter, in order to use it as a heat source for boiler in the subsequent step, by a wet treatment by spray of cooling water or using a scrubber. However, flying ash or dust containing a volatile component or molten dust is included in the high-temperature exhaust gas discharged from the incinerator or melting furnace, and the temperature control of such a high-exhaust gas only by cooling water spray causes the problem of the adhesion of the liquefied matter of the volatile component or the solidified matter of the molten dust to the inner wall of a temperature control tower. Further, the wet treatment has a problem in that it is disadvantageous in cost of equipment such as necessity of water treatment equipment because a water-soluble component is contained in the volatile component or molten dust.

In order to prevent the adhesion of the deposit of the inner wall of the temperature control tower, therefore, it is proposed to blow a high-temperature exhaust gas branched from an exhaust gas inlet duct obliquely upward from a purge gas blowing duct in the tangential direction of the circle formed by the horizontal section of the temperature control tower to whirl it as purge gas, or to provide an overflow dam on the upper part within the temperature control tower to fall the water overflowing the overflow dam along the inner wall.

It is also proposed to provide a plurality of high-pressure liquid injection nozzles on the wall of the temperature control tower to blow a high-pressure fluid to the inner wall of the temperature control tower through the high-pressure injection nozzles, thereby removing the adhered dust.

However, since the volatile component or molten dust contained in the high-temperature exhaust gas cannot be sufficiently cooled in the method of blowing and whirling the high-temperature exhaust gas as purge gas, the preventing effect against the adhesion of the volatile component or molten dust to the inner wall of the temperature control tower is not always sufficient. The method of falling water along the inner wall of the temperature control tower requires the water treatment equipment for treating the water-soluble component similarly to the wet treatment. The injection of the high-pressure fluid is only a mere expectant treatment, and it cannot prevent the adhesion of the volatile component or molten dust itself contained in the high-temperature exhaust gas to the inner wall of the temperature control tower.

In the case of an apparatus for incinerating and melting a waste containing metal such as a direct melting furnace of industrial waste, the adhesion of low-melting point materials of alkali metal such as lead (Pb), zinc (Zn), sodium (Na), potassium (K) and the like is more remarkable because they are contained in large quantities. In the technique of obtaining reduced iron by starting from a carbon reducing agent such as coal and an oxidized metal such as iron ore or a waste containing the oxidized metal and performing reduction or reduction and melting at a high temperature of 1000° C. or higher, particularly, the cooling of gas and the prevention of adhesion are hardly reconciled because such starting materials contain large quantities of low-melting point materials or volatile components and also generate an extremely high-temperature gas, and an effective temperature control device has not been proposed yet at the present time.

SUMMARY OF THE INVENTION

One object of this invention is to provide a temperature control device for effectively preventing the adhesion of a volatile component or molten dust to the inner wall of a temperature control tower and effectively cooling high-temperature exhaust gas, and another object is to provide a temperature control method for high-temperature exhaust gas.

According to this invention, there is provided a temperature control device having a temperature control tower for controlling a blown high-temperature exhaust gas to a proper temperature and discharging the temperature-controlled exhaust gas to the subsequent step side, the temperature control tower comprising a cooling water spray means for spraying cooling water to about the center of the gas flow of the high-temperature exhaust gas and a cooling gas injecting means for injecting a cooling gas along the inner wall of the temperature control device.

The above-mentioned temperature control device further comprises an exhaust gas inlet duct for guiding the high-temperature exhaust gas discharged from a high-temperature gas generating source to the temperature control tower, a gas blowing port provided on the upper part of the temperature control tower so as to communicate with the exhaust gas inlet duct, and a lower discharge duct for discharging the temperature-controlled exhaust gas, wherein the cooling water spray means is constituted so as to spray the cooling water downward to about the center of the gas flow of the high-temperature exhaust gas blown into the temperature control tower, and the cooling gas injecting means is constituted so as to inject the cooling gas downward along the inner wall of the temperature control tower.

In the above-mentioned temperature control device, the cooling gas injecting means is constituted so as to inject the cooling gas downward along the inner wall of the temperature control tower, a plurality of cooling gas injecting means is arranged in the vertical direction of the temperature control tower, the body wall of the temperature control tower has at least two extended step parts extended in diameter toward the lower side, and the cooling gas injecting means are provided on these extended step parts.

In the above-mentioned temperature control device, the cooling gas injecting means is arranged in the direction of injecting the cooling gas obliquely downward to the inner wall of the temperature control tower so that the cooling gas forms a downward whirling gas flow along the inner wall of the temperature control tower.

In the above-mentioned temperature control device, the cooling gas injecting means provided on the two or more extended step parts are constituted so that the cooling gas injecting means provided on the upper extended step part injects the cooling gas in the larger quantity than the cooling gas injecting means provided on the lower extended step part.

The above-mentioned temperature control device further comprises a cooling water injection control means for regulating the injection quantity of the cooling water and a cooling gas injection control means for regulating the injection quantity of the cooling gas, so that the quantity and temperature of the exhaust gas to be discharged with temperature control are constant.

The temperature control device further comprises a cooling water injection control means for regulating the injection quantity of the cooling water and a cooling gas injection control means for regulating the injection quantity of the cooling gas so that the temperature and moisture content of the exhaust gas to be discharged with temperature control are constant.

In the above-mentioned temperature control device, the exhaust gas inlet duct is formed in a reverse V-bent shape between the high-temperature gas generating source and the gas blowing means.

In the above-mentioned temperature control device, the high-temperature gas generating source is a reduced metal manufacturing apparatus for manufacturing reduced iron by starting from a carbon reducing agent such as coal and an oxidized metal such as iron ore or a waste containing the oxidized metal and performing reduction or reduction and melting at a high temperature.

According to this, since the cooling water is injected to about the center of the gas flow of the high-temperature exhaust gas blown into the temperature control tower, and the cooling gas is injected along the inner wall of the temperature control tower, the high-temperature exhaust gas and the volatile component or molted dust are effectively cooled, and the volatile component or molten dust is solidified. The inner wall of the temperature control tower is shielded from the high-temperature exhaust gas by the gas flow of the cooling gas flowing along the inner wall of the temperature control tower without being disturbed by the spray of cooling water. Accordingly, the solidified volatile component or molten dust is not only blown off, even if about to adhered to the inner wall of the temperature control tower, by the gas flow of cooling gas without approaching to the inner wall surface, but also cannot be adhered to the inner wall of the temperature control tower because of its solidification.

The volatile component or molten dust contained in the high-temperature exhaust gas can be cooled more sufficiently than in the structure of blowing and whirling of the high-temperature exhaust gas as purge gas, and an excellent preventing effect against the adhesion to the inner wall of the temperature control tower can be provided. Since the cooling water is evaporated and discharged with the exhaust gas, different from the structure of falling water along the inner wall, the water treatment equipment for treating the water-soluble component is dispensed with. The adhesion of the volatile component or molten dust itself contained in the high-temperature exhaust gas to the inner wall of the temperature control tower as in the injection of a high-pressure fluid can be eliminated.

Since the cooling gas injecting means are provided on the two or more extended step parts provided on the temperature control tower so that the cooling gas forms a downward whirling gas flow along the inner wall of the temperature control tower, the inner wall of the temperature control tower can be widely covered with the gas flow of the cooling gas to effectively prevent the direct contact with the high-temperature exhaust gas.

Since the cooling gas injecting means provided on the upper extended step part injects the cooling gas in the larger quantity than the cooling gas injection means provided on the lower extended step part, the inner wall near the gas blowing port of the temperature control tower is covered with a large quantity of the cooling gas flow, so that a large quantity of the volatile component or molten dust contained in the high-temperature exhaust gas just after blowing, even if solidified, can be effectively prevented from being adhered to the inner wall near the gas blowing port of the temperature control tower.

Further, since the quantity and temperature of the exhaust gas discharged with temperature control are controlled so as to be constant, the exhaust gas can be properly discharged without readily increasing the exhaust gas quantity in addition to the stable treatment of exhaust gas in the subsequent step, the enlargement of the apparatus on the subsequent step side can be prevented.

Since the temperature and moisture content of the exhaust gas to be discharged with temperature control are controlled so as to be constant, the adhesion of the flying ash or dust component to a duct or heat exchanger in the subsequent step or the corrosion by acid thereof can be prevented in addition of the stable treatment of the exhaust gas in the subsequent step.

Since the inertial force of the high-temperature exhaust gas is suppressed by the bent part of the exhaust gas inlet duct to prevent the drift in the blowing through the gas blowing port of the temperature control tower, the disturbance of the gas flow of the cooling gas flowing along the inner wall of the temperature control tower can be prevented without deteriorating the cooling effect within the temperature control device.

Although the high-temperature exhaust gas discharged from the reduced metal manufacturing apparatus contains a large quantity of volatile or molten dust component, such a high-temperature exhaust gas can be also temperature-controlled while effectively cooling and solidifying the volatile or molten dust component by spray of cooling water and injection of cooling water and also preventing the adhesion of a large quantity of the solidified volatile or molten dust component to the inner wall of the temperature control tower.

According to this invention, further, there is provided a temperature control method for high-temperature exhaust gas comprising blowing a high-temperature exhaust gas discharged from a high-temperature gas generating source to a temperature control tower from a gas blowing port provided in the upper part thereof through an exhaust gas inlet duct, temperature-controlling the blown high-temperature exhaust gas to a proper temperature, and discharging it to the subsequent step side through a lower discharge duct, wherein cooling water is sprayed from the upper part of the temperature control tower to about the center of the gas flow of the high-temperature exhaust gas, and cooling gas is injected obliquely downward so as to form a whirling gas flow along the inner wall of the temperature control tower.

In the above-mentioned temperature control method for high-temperature exhaust gas, the temperature control tower comprises two or more extended step parts extended in diameter toward the lower side, the cooling gas is injected obliquely down so as to form a whirling gas flow along the inner wall of temperature control tower in the larger quantity from the cooling gas injecting means provided on the upper extended step part than from the cooling gas injection means provided on the lower side, the injection quantity of the cooling gas and the spray quantity of the cooling water are regulated so that the quantity and temperature of the exhaust gas discharged with temperature control through the lower discharge duct are constant, and the injection quantity of the cooling gas and the spray quantity of the cooling water are regulated so that the temperature and moisture content of the exhaust gas temperature discharged with temperature control through the lower discharge duct are constant.

In the above-mentioned temperature control method for high-temperature exhaust gas, the high-temperature exhaust gas discharged from the high-temperature generating source to the temperature control tower through the gas blowing port is once ascended obliquely and then descended obliquely in the blowing.

In the above-mentioned temperature control method for high-temperature exhaust gas, the high-temperature exhaust gas discharged from the high-temperature gas generating source, which is a reduced metal manufacturing apparatus for manufacturing reduced iron by starting from a carbon reducing agent such as coal and an oxidized metal such as iron ore or a waste containing the oxidized metal and performing reduction or reduction and melting at a high temperature, to the temperature control tower through the gas blowing port.

According to this, since the cooling water is sprayed to about the center of the gas flow of the high-temperature exhaust gas blown into the temperature control tower, and the cooling gas is injected along the inner wall of the temperature control tower, the high-temperature exhaust gas and the volatile or molten dust component are effectively cooled, and the volatile or molten dust component is solidified. The inner wall of the temperature control tower is shielded from the high-temperature exhaust bas by the gas flow of the cooling gas flowing along the inner wall of the temperature control tower without being disturbed by the spray of cooling water. Accordingly, the solidified volatile or molten dust component is not only blown off, even if about to adhere to the inner wall of the temperature control tower, by the gas flow of the cooling gas without approaching to the inner wall surface, but also cannot be adhered to the inner wall of the temperature control tower because of its solidification.

The volatile component or molten dust contained in the high-temperature exhaust gas can be cooled more sufficiently than in the structure of blowing and whirling the high-temperature exhaust gas as purge gas, and an excellent preventing effect against the adhesion to the inner wall of the temperature control tower can be provided. Since the cooling water is evaporated and discharged with the exhaust gas, different from the structure of falling water along the inner wall, the water treatment equipment for treating the water-soluble component is dispensed with. The adhesion of the volatile component or molten dust itself contained in the high-temperature exhaust gas to the inner wall of the temperature control tower as in the injection of a high-pressure fluid can be eliminated.

Since the quantity and temperature of the exhaust gas to be discharged with temperature control are controlled so as to be constant, the exhaust gas can be properly discharged without readily increasing the exhaust gas quantity in addition to the stable treatment of exhaust gas in the subsequent step, and the enlargement of the subsequent step-side apparatus can be prevented.

Since the temperature and moisture content of the exhaust gas to be discharged with temperature control are controlled so as to be constant, the adhesion of flying ash or dust component to a duct or heat exchange or the corrosion by acid thereof in the subsequent step can be prevented in addition to the stable treatment of the exhaust gas in the subsequent step.

Since the inertial force of the high-temperature exhaust gas is suppressed by the bent part of the exhaust gas inlet duct to prevent the drift in the blowing from the gas blowing port of the temperature control tower, the disturbance of the gas flow of the cooling gas flowing along the inner wall of the temperature control tower can be prevented without deteriorating the cooling effect within the temperature control device.

Although the high-temperature exhaust gas discharged from the reduced metal manufacturing apparatus contains a large quantity of volatile or molten dust component, such a high-temperature exhaust gas can be also temperature-controlled while effectively cooling and solidifying the volatile or molten dust component by spray of cooling water and injection of cooling gas and preventing the adhesion of the solidified volatile or molten dust component to the inner wall of the temperature control tower.

DESCRIPTION OF THE PREFERRED EMBODIMENTS

The structure of a temperature control device according to a preferred embodiment for realizing the temperature control method for high-temperature exhaust gas of this invention is described in detail.

Figure 1:
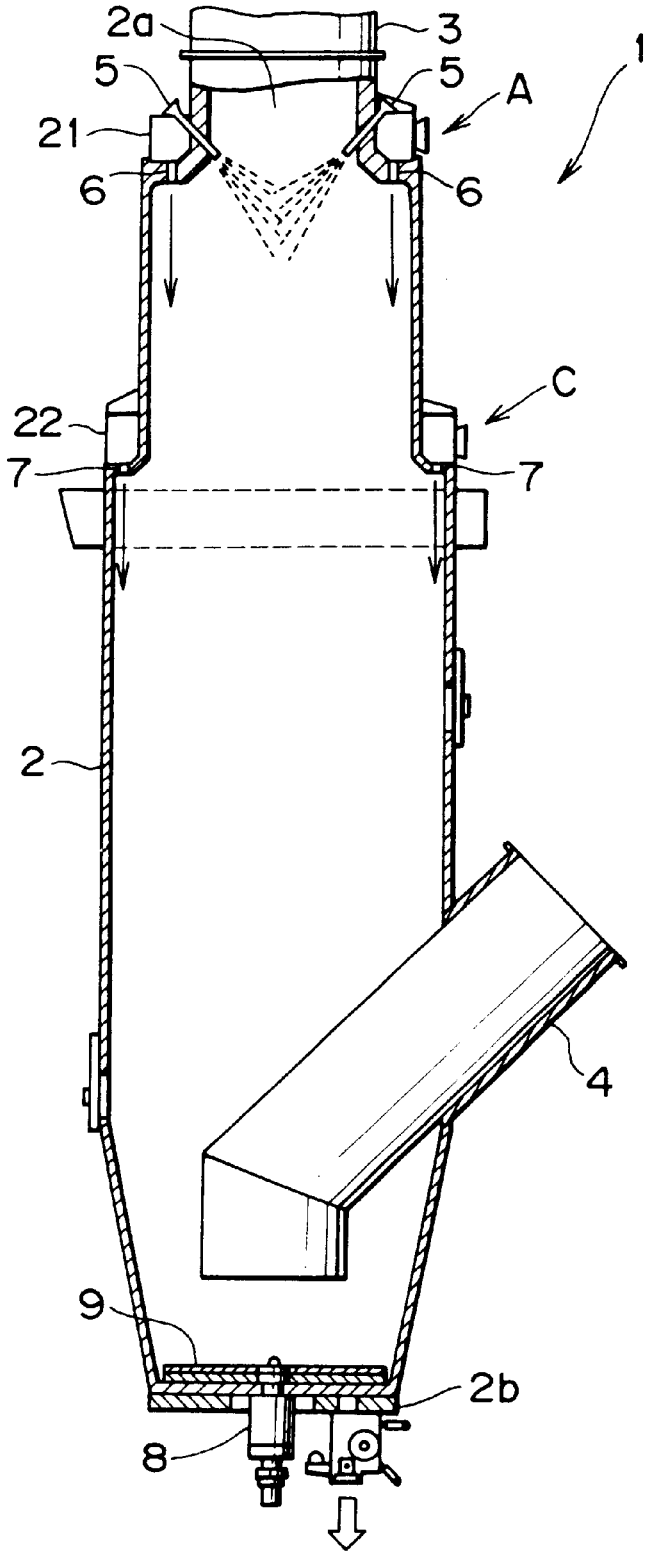
FIG. 1 is an essential side sectional view of a temperature control device according to a preferred embodiment of this invention.

Denoted at 1 in FIG. 1 is a temperature control device, and the temperature control device 1 is mainly formed of a vertically long stepped cylindrical temperature control tower 2, an exhaust gas inlet duct 3 connected to a gas blowing port 2*a* provided on the upper part of the temperature control tower 2 to carry a high-temperature exhaust gas discharged from a high-temperature gas generating source not shown into the temperature control tower 2, and a lower discharge duct 4 opened to the bottom side of the temperature control tower 2 and extended obliquely upward through the body wall of the temperature control tower 2 to discharge the exhaust gas temperature-controlled to a proper temperature to the subsequent step side, for example, a boiler or bag filter not shown.

Figure 2A:
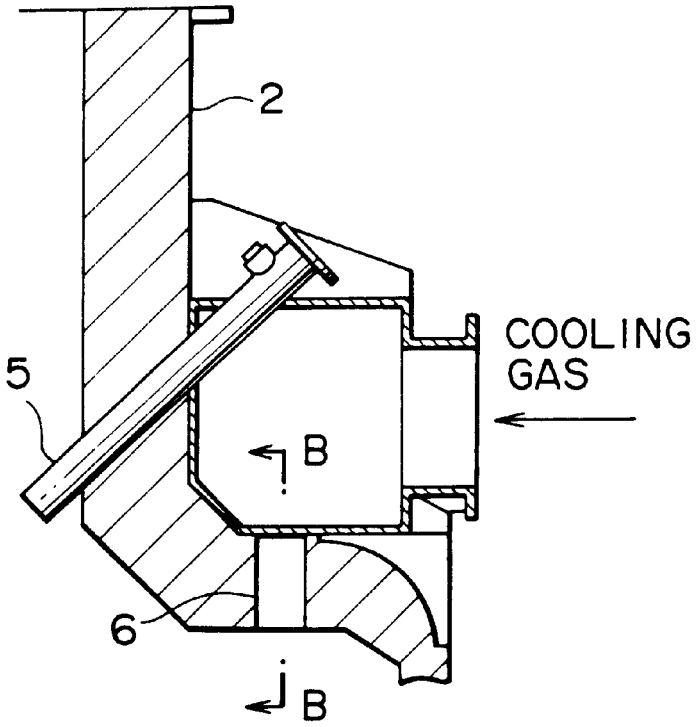
FIG. 2A is a detail view of part A of FIG. 1.
Figure 2B:
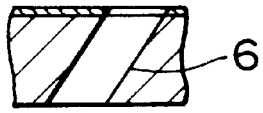
FIG. 2B is a sectional view taken along line B—B of FIG. 2A.
Figure 2C:
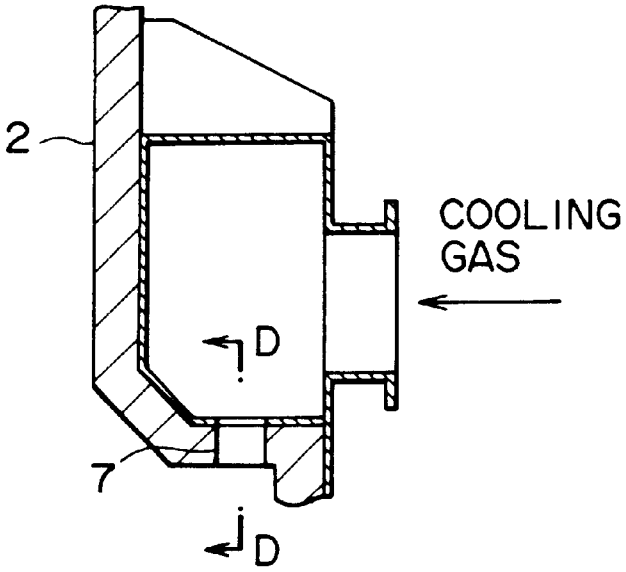
FIG. 2C is a detail view of part D of FIG. 1.
Figure 2D:
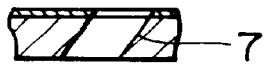
FIG. 2D is a sectional view taken along line D—D of FIG. 2C.

The temperature control tower 2, the body wall of which is formed into the stepped cylindrical shape as described above, comprises a first extended step part 21 formed on the slightly lower side from the upper end, as is apparent from each of FIG. 1 and FIGS. 2A, B, C, and D, and a second extended step part 22 larger in diameter than the first extended stepped part 21 formed in a position upper than the vertical middle under the first extended step part 21. A plurality of cooling water spray nozzles 5 for spraying cooling water toward the center of the gas flow of the high-temperature exhaust gas blown from the gas blowing port 2*a* are provided on the circumferential part of the minor diameter part on the upper side of the first extended stepped part 21 so as to extend obliquely down through the minor diameter part. The intention of setting the ports of the cooling water spray nozzles 5 obliquely down to about the center of the gas flow of the high-temperature exhaust gas is the prevention of the disturbance of the gas flow of cooling gas described later. The direction of the ports of the cooling water spray nozzles 5 is not particularly limited, but set to about 45° obliquely down in this embodiment.

A plurality of first stage cooling gas injection nozzles 6 for injecting cooling gas from the tangential direction of forming an obliquely down whirling gas flow along the inner wall of the temperature control tower 2 is provided on the annular plane opposed to the lower side within the temperature control tower 2 of the first extended step part 21, and a plurality of second stage cooling gas injection nozzles 7 of the same structure as the first stage cooing gas injection nozzles 6 for injecting cooling gas from the tangential direction of forming the obliquely down whirling gas flow along the inner wall of the temperature control tower 2 is provided on the annular plane opposed to the lower side within the temperature control tower 2 of the second extended step part 22. These are provided with the intention of whirling the cooling gas downward along the inner wall of the temperature control tower 2 to prevent the direct contact of the high-temperature exhaust gas with the inner wall of the temperature control tower 2 and blowing off the solidified volatile or molten dust component to prevent the adhesion of dust to the inner wall of the temperature control tower 2. The high-temperature exhaust gas and the volatile or molten dust component are cooled and solidified also by this cooling gas.

This temperature control device 1 comprises the first stage cooling gas injection nozzles 6 and the second stage cooling gas injection nozzles 7 having a vertical relation as described above. A third extended step part may be provided in a lower position from the second stage cooling gas injection nozzles 7 to provide a plurality of third stage cooling gas injection nozzles on the annular plane opposed to the lower side within the temperature control tower 2 of the third extended step part. Further, by increasing the number of arrangement stages of the cooling gas injection nozzles, the effect that the mixing of high-temperature exhaust gas with cooling gas becomes more difficult can be provided. Accordingly, the number of arrangement stages of the cooling gas injection nozzles is not limited.

The temperature control tower 2 has, on the bottom, a dust scraper 9 rotated about the diameter center of the bottom of the temperature control tower 2 by the operation of a cyclo speed reducer 8 to scrape and gather the dust adhered to or collected in the bottom and discharge it out of the temperature control tower 2 through a dust discharge port 2*b* opened in the bottom.

Figure 3:
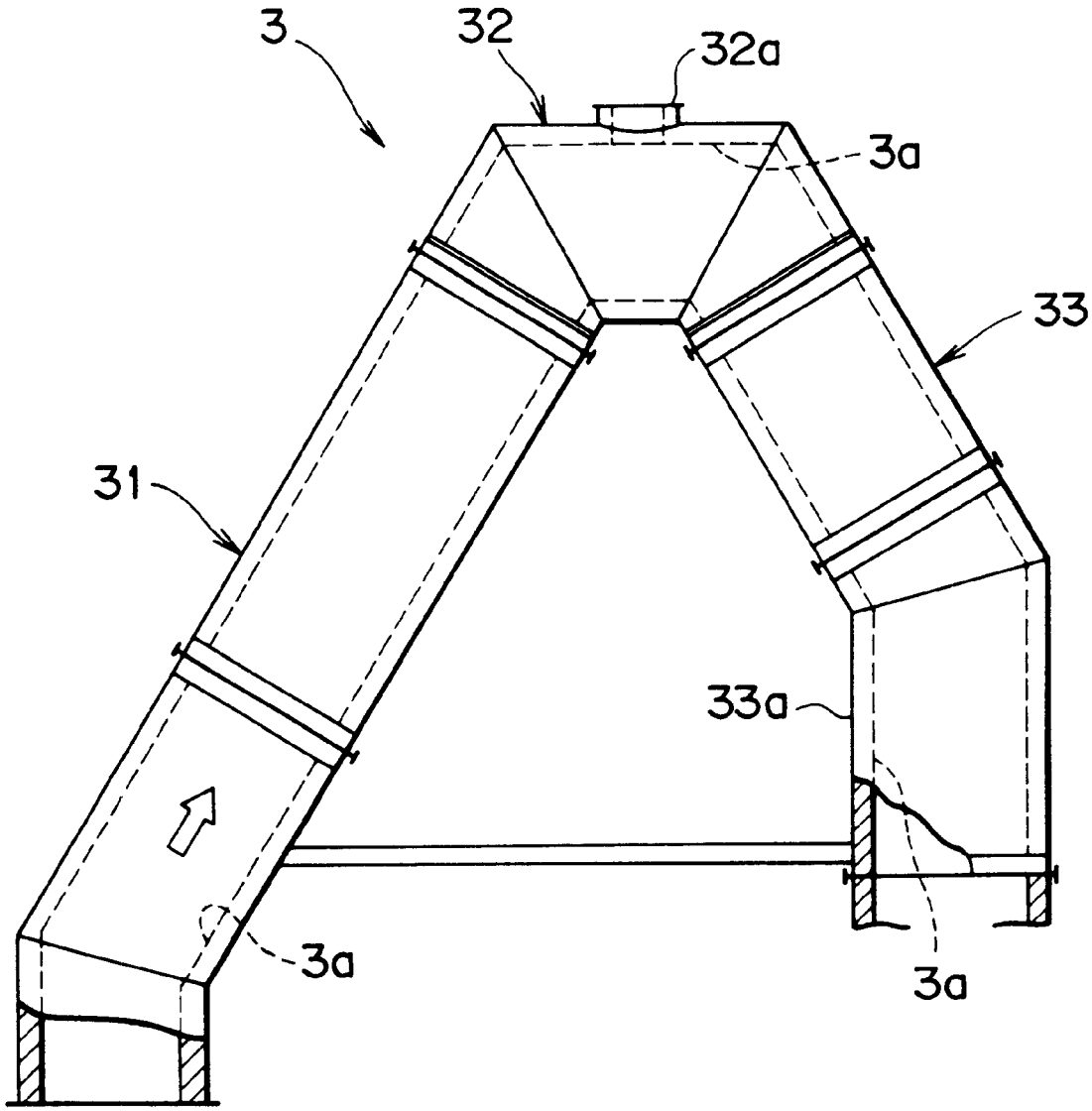
FIG. 3 is a side view of the exhaust gas inlet duct of the temperature control device according to the embodiment of this invention.

The exhaust gas inlet duct 3 guides the high-temperature exhaust gas containing the volatile component or molted dust, which is discharged from a high temperature gas generating source such as a reduced metal manufacturing apparatus not shown for manufacturing reduced iron by starting from a carbon reducing agent such as coal and an oxidized metal such as iron ore or a waste containing the oxidized metal and reducing or reducing and melting the oxidized metal at high temperature, to the gas blowing port 2*a*. The exhaust gas inlet duct 3 is formed in a reverse V-bent shape as shown in FIG. 3.

The exhaust gas inlet duct 3 is set low on the upstream side (high-temperature gas generating source side) into which the high-temperature gas flows, and it is formed of an obliquely upward riser part 31 for ascending the inflow high-temperature exhaust gas obliquely, a horizontal duct part 32 continued to the upper end of the rise duct part 21 and having a manhole 32*a* in the upper part, and an obliquely down downcomer duct part 33 for descending the high-temperature exhaust gas obliquely, which is continued to the anti-riser part 31 side of the horizontal duct part 32 and has a vertical duct part 33*a* to be connected to the gas blowing port 2*a* at the tip. Namely, the exhaust gas inlet duct 3 is formed in the reverse V-bent shape (trapezoidal mountain shape in FIG. 3) high between the high-temperature gas generating source and the gas blowing port.

The reason of setting the exhaust gas inlet duct 3 in the reverse V-bent shape as described above is that the inertial force of the gas flow of high-temperature exhaust gas is suppressed by the bent part of the exhaust gas inlet duct 3, whereby the drift of the high-temperature exhaust gas and dust is prevented in the blowing into the temperature control tower 2 to minimize the disturbance of the downward whirling flow of the cooling gas along the inner wall of the temperature control tower. Such a structure of the exhaust gas inlet duct 3 also provides the effect that the volatile component, even if coagulated and settled, and the molten dust, even if settled, can be prevented form being accumulated on the inner wall of the exhaust gas inlet duct 3 so as not to obstruct the high-temperature exhaust gas flow.

The inside surface of the exhaust gas inlet duct 3 is covered with a refractory 3*a*. The reduction in temperature of the high-temperature exhaust gas flowing in the exhaust gas inlet duct 3 is prevented, whereby the volatile component or molten dust contained in the high-temperature exhaust gas can be guided into the temperature control tower 2 as it is in the evaporated state or melted state without solidification.

On the lower discharge duct 4 of the temperature control tower 2 having such a structure are mounted a gas flowmeter as means for measuring the flow rate of the temperature-controlled exhaust gas discharged from the lower discharge duct 4 of the temperature control tower 2 having such a structure and a thermometer as means for detecting the temperature thereof, which are omitted in the drawings. Further, a cooling water quantity control device that is a cooling spray control means for controlling the opening of a cooling water control valve for regulating the spray quantity of cooling water and a gas quantity control device that is a cooling gas injection control means for controlling the opening of a gas control valve for regulating the injection quantity of cooling gas are provided to control the flow rate and temperature of the temperature-controlled exhaust gas so as to be constant on the basis of the detection signals from the gas flowmeter and thermometer. Otherwise, a moisture detector may be provided as means for measuring the moisture content in exhaust gas to regulate the openings of the cooling water control valve and the gas control valve so that the temperature and moisture content of the temperature-controlled exhaust gas are constant.

In the cooling to the same temperature only by spray of cooling gas, the increase in injection quantity of cooling gas is required because the quantity of high-temperature exhaust gas is increased when the injection quantity is left as it is, and the quantity of the exhaust gas discharged from the lower discharge duct is increased in proportion to the injection quantity of the cooling gas, but the exhaust gas is preferable for heat-recovered because of its high latent heat. In the cooling to the same temperature only by spray of cooling water, the increase in spray quantity of cooling water is similarly required, and the moisture content in the exhaust gas discharged from the lower discharge duct is increased in proportion to the spray quantity of cooling water, which causes a corrosion trouble by acid in the boiler or the like in the after process, and the exhaust gas is not preferable for heat recovery because of its low latent heat.

Since the high-temperature exhaust gas is temperature-regulated by cooling by the synergistic effect of spray of cooling water and injection of cooling gas in the temperature control device 1 according to this embodiment, the temperature of exhaust gas and the water content in exhaust gas can be properly regulated by the equipment structure in the subsequent step such as boiler or combustion air preheater or the heat recovering quantity. When the heat recovery quantity may be small, or an exhaust gas with low acid dew point is treated, for example, the exhaust gas temperature on heat recovery side can be properly kept since the temperature of exhaust gas can be easily regulated to be constant by increasing the spray quantity of cooling water and reducing the injection quantity of cooling gas. When a high heat recovery quantity is required, or an exhaust gas with high acid dew point is treated, contrary to this, the reduction in the spray quantity of cooling water and the increase in the injection quantity of cooling gas are sufficient. When the temperature and water content of the temperature-controlled exhaust gas are controlled to be constant, the cooling water can be sprayed in the quantity according to the total exhaust gas quantity, compensating the remainder by the cooling gas.

There is a high-temperature gas generating source for discharging a high-temperature exhaust gas containing a low corrosive gas such as sulfur dioxide ($SO_2$) or the like. When the high-temperature exhaust gas discharged from such a high temperature gas generating source is temperature-controlled, the injection quantity of cooling gas is increased, and the spray quantity of cooling water is reduced to suppress the acid dew point low, whereby an efficient heat recovery can be performed. The acid dew point is determined depending on the moisture content and low-temperature corrosive gas quantity contained in exhaust gas, and it is reduced when the moisture content or low-temperature corrosive gas quantity is reduced. Thus, when the spray quantity of cooling water is reduced to suppress the acid dew point low, the regulation of the lowest temperature (for prevention of low-temperature acid corrosion) of the heat transfer surface of a heat exchanger such as boiler in the after process is eased, so that a perfect opposed flow type heat exchanger excellent in heat transfer efficiency, for example, can be adapted.

When a high-temperature exhaust gas containing no low-temperature corrosive gas is temperature-controlled, the spray quantity of cooling water is increased, and the injection quantity of cooling gas is reduced, whereby the quantity of the temperature-controlled exhaust gas discharged from the lower discharge nozzle can be minimized. It is not necessary to increase the injection quantity of cooling gas in order to lower the acid dew point because there is no need to fear the low temperature corrosion, and the injection quantity of cooling gas can be minimized by utilizing the evaporating latent heat of cooling water.

The effect of the temperature control device 1 according to this embodiment is described. The high-temperature exhaust gas containing the volatile component or molten dust, which is discharged from the high temperature gas generation source, is blown into the temperature control tower 2 from the gas blowing port 2*a* provided in the upper part of the temperature control tower 2 through the exhaust gas inlet duct 3 while keeping at a prescribed temperature never causing the solidification of the molten dust by the heat insulating effect of the refractory 3*a*. At this time, since the exhaust gas inlet duct 3 is formed in the reverse V-bent shape described above, the inertial force of the high-temperature exhaust gas is suppressed, and the high temperature exhaust gas is blown into the temperature control tower 2 without causing any drift. The high-temperature exhaust gas blown into the temperature control tower 2 is descended to the bottom while the heat is carried away by the evaporation of cooling water sprayed from a plurality of cooling water spray nozzles 5 provided on the upper part to reduce the temperature, and the temperature-controlled exhaust gas is discharged to the subsequent step side through the lower discharge duct 4.

Simultaneously with the spray of cooling water from the cooling water spray nozzles 5, cooling gas is injected from the first and second stage cooling gas injection nozzles 6, 7. Since the cooling water is sprayed to about the center of the gas flow of the blown high-temperature exhaust gas, the injected cooling gas forms a downward whirling gas flow without being influenced by the sprayed cooling water to cover the inner wall of the temperature control tower 2. The temperature of the gas flow of high-temperature exhaust gas falls according to the descent to solidify the volatile or molten dust component in the high-temperature gas. However, since the direct contact of the exhaust gas with the inner wall of the temperature control tower 2 is prevented by the downward whirling gas flow of cooling gas, the solidified volatile or molten dust component is never adhered to the inner wall of the temperature control tower 2, and even if the exhaust gas approaches to the inner wall of the temperature control tower 2, the solidified volatile or molten dust component cannot be adhered to the inner wall since it is further cooled by the cooling gas.

Since the first stage and second stage cooling gas injection nozzles 6, 7 are provided, as described above, so that the high-temperature exhaust gas can be effectively cooled while preventing the adhesion of the solidified volatile or molten dust component to the inner wall of the temperature control tower 2 even in the treatment of a large quantity of high-temperature exhaust gas, this structure is contributable to the miniaturization of the temperature control tower 2. Further, since the upper inner wall part of the temperature control tower 2 where the blown high-temperature exhaust gas having the highest temperature and containing a large quantity of the volatile or molted dust component flows is covered with a large quantity of cooling gas by injecting the cooling gas from the first stage cooling gas injection nozzles 6 on the upper side in the larger quantity than from the second stage cooling gas injection nozzles 7, the exhaust gas can be properly discharged without readily increasing the exhaust gas quantity in addition to the sure prevention of the adhesion to the solidified volatile or molted dust component to this upper inner wall part. Therefore, the enlargement of the subsequent step-side equipment can be prevented.

Further, since the flow rate and temperature of the temperature-controlled exhaust gas can be regulated to be constant by regulating the spray quantity of cooling water and the injection quantity of cooling gas, the exhaust gas can be property discharged without readily increasing the exhaust gas quantity in addition to the stable treatment of exhaust gas in the subsequent step, and the enlargement on the subsequent step-side equipment can be prevented. The adhesion to the duct or heat exchanger in the subsequent step or the corrosion by acid thereof can be prevented in addition to the stable treatment of exhaust gas in the subsequent step.

In the application to the temperature control of, for example, a high-temperature exhaust gas containing particularly a large quantity of volatile component or molten dust, which is discharged from a reduced metal manufacturing apparatus not shown for manufacturing reduced iron by starting from a carbon reducing agent such as coal and an oxidized metal such as iron ore or a waste containing the oxidized metal and performing reduction or reduction and melting at a high temperature, the preventing effect against the adhesion of the solidified volatile component or molten dust is particularly remarkable.

According to the temperature control device 1 according to this embodiment, the volatile component or molten dust contained in high-temperature exhaust gas can be sufficiently cooled, and the preventing effect against the adhesion to the inner wall of the temperature control tower is excellent. Since the cooling water is evaporated and discharged with exhaust gas, the water treatment equipment for treating the water-soluble component is dispensed with.

For the high-temperature exhaust gas containing a large quantity of low-melting point materials such as lead, zinc and the like, which is discharged from an apparatus for incinerating and melting a waste containing metal such as direct melting furnace of industrial waste, and the high-temperature exhaust gas containing a large quantity of volatile or molten dust component, which is discharged from a reduced metal manufacturing apparatus for manufacturing reduced iron by starting from of a carbon reducing agent such as coal and an oxidized metal such as iron ore or a waste containing the oxidized metal and performing reduction or reduction and melting at a high temperature of 1000° C. or higher, the temperature control can be effectively performed while preventing the adhesion of the dust to the inner wall of the temperature control tower.

EXAMPLE

Figure 4:
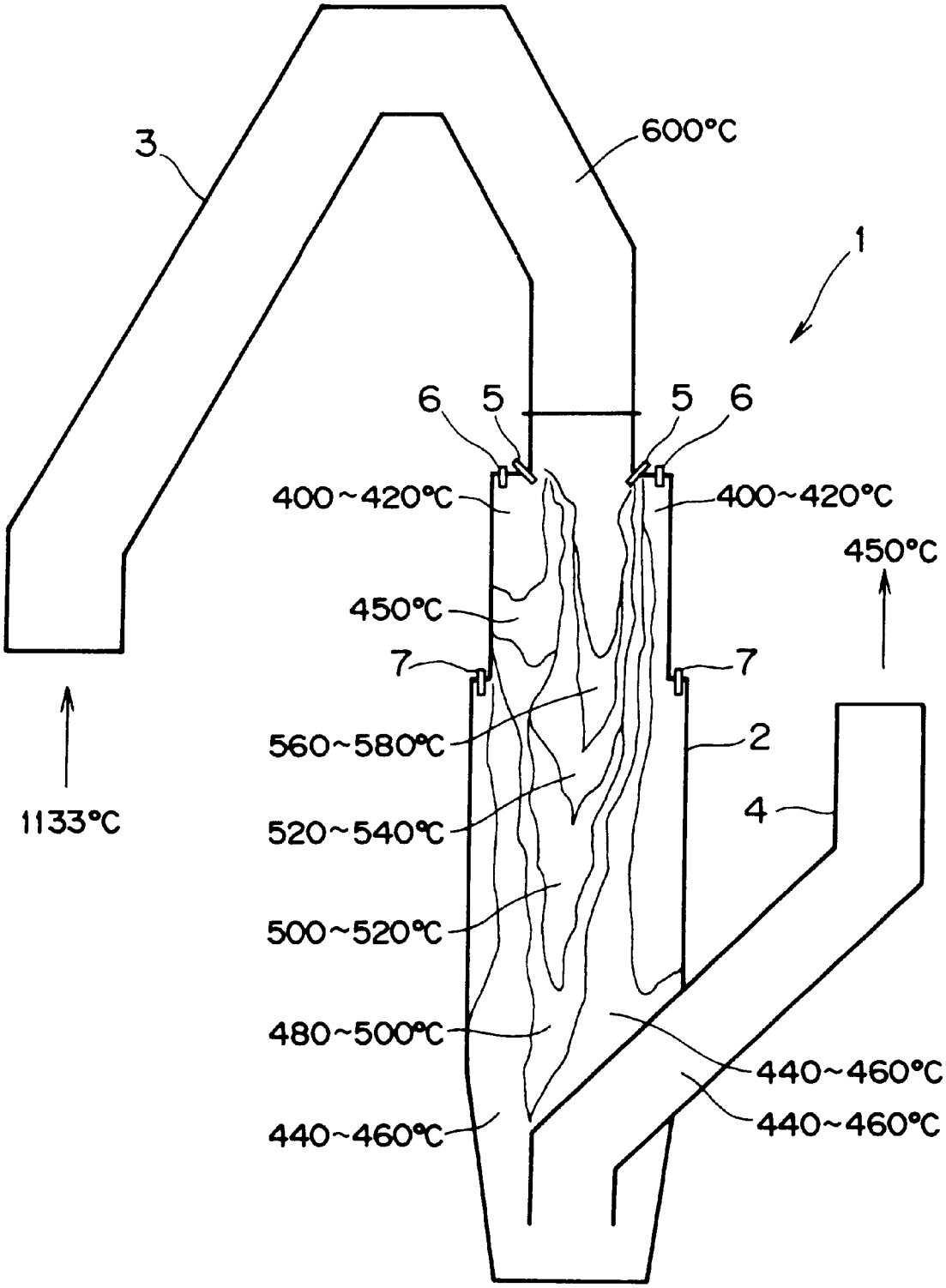
FIG. 4 is a view showing the temperature distribution of the temperature control device according to an example of this invention.

An example of the temperature control of the high-temperature exhaust gas discharged from a reduced iron manufacturing apparatus by use of the temperature control device according to the preferred embodiment is illustrated in reference to FIG. 4 showing the temperature distribution. The high-temperature exhaust gas discharged from the reduced iron manufacturing apparatus not shown contains a large quantity of volatile or molten dust component (lead, zinc and oxides thereof). The temperature of the high-temperature exhaust gas is 700–1400° C. The high-temperature exhaust gas after complete combustion of CO prior to the blowing to the temperature control tower 2 consists of 20% by volume of $CO_2$, 67.3% by volume of $N_2$, 11.8% by volume of $H_2O$ and 0.3% by volume of $O_2$ Such a high-temperature exhaust gas is temperature-controlled to about 200° C. to 350–600° C. depending on the kind of the after-process equipment. More specifically, the exhaust gas discharged from the lower discharge duct 4 is controlled to the lower temperature side from about 200° C. to 350° C. when the heat recovery quantity may be small, the melting point or softening point of the dust is low, or the exhaust gas is treated with a general bag filter, and to the higher temperature side of 600° C. when a large quantity of heat recovery is required, the melting point or softening point of the dust is high, or when the exhaust gas is supplied to a boiler or treated with a high-temperature bag filter.

As the cooling gas, any one having a temperature lower than the temperature of the temperature-controlled exhaust gas discharged from the lower discharge duct 4 or lower than the softening point or melting point of the volatile or molten dust component can be used, and it contains no volatile or molten dust component. For example, air, nitrogen, an inert gas or the gas discharged from the lower discharge duct 4 and treated with a bag filter can be used, and the gas discharged from the raw material drying step can be used as cooling gas when the high-temperature gas generating source is a reduced metal manufacturing apparatus or waste disposal apparatus. Further, the combusting air or secondary combusting air used for heating furnace, incinerator, melting furnace, reduced metal manufacturing apparatus or waste disposal apparatus can be used as the cooling gas.

In this example, ordinary temperature air was used as the cooling gas to inject 370 $m^3$/min of air at a flow velocity of 20 m/s from the first stage cooling gas injection nozzles 6 and 350 $m^3$/min of air at a flow velocity of 20 m/s from the second stage cooling gas injection nozzles 7, and 65 $dm^3$/min of cooling water was sprayed from the cooling water spray nozzles 5. At the result, the high-temperature exhaust gas of 1133° C. flowing to the exhaust gas inlet duct 3 was effectively temperature-controlled, and the temperature-controlled exhaust gas of 450° C. was discharged from the lower discharge duct 4. It is apparent from the drawing that the high-temperature exhaust gas is effectively cooled to 400–420° C. uniformly extending from the upper part to the lower part in the part adjacent to the inner wall of the temperature control tower where the cooling gas is injected from the first stage cooling gas injection nozzles 6 and the second stage cooling gas injection nozzles 7 to form the whirling gas flow, and the downward whirling gas flow of cooling air is not disturbed. The injection speed of cooling gas is set preferably to 18 m/s or more, more preferably to 20 m/s or more.

When a combustible gas such as CO of about 0–2% by volume is contained in the high-temperature exhaust gas discharged from the reduced metal manufacturing apparatus, it is burnt by the ordinary temperature air injected from the first and second stage cooling gas injection nozzles 6, 7 without being released to the atmosphere, and this device is excellent in prevention of environmental contamination.

We claim:

1. A temperature control device comprising:

a temperature control tower for controlling a blown high-temperature exhaust gas to a proper temperature;

a cooling water spray means for spraying cooling water to about the center of the gas flow of the high-temperature exhaust gas blown into the temperature control tower; and a cooling gas injecting means for injecting cooling gas along an inner wall of the temperature control tower.

2. A temperature control device according to claim 1 which further comprises an exhaust gas inlet duct for guiding the high-temperature exhaust gas discharged from a high-temperature gas generating source to the temperature control tower, a gas blowing port provided on an upper part of the temperature control tower so as to communicate with the exhaust gas inlet duct, and a lower discharge duct below the exhaust gas inlet duct for discharging the temperature-controlled exhaust gas.

3. A temperature control device according to claim 1 wherein the cooling water spray means is constituted so as to spray the cooling water downward to about the center of the gas flow of the high-temperature exhaust gas blown to the temperature control tower.

4. A temperature control device according to claim 1 wherein the cooling gas injecting means is constituted so as to inject the cooling gas downward along the inner wall of the temperature control tower.

5. A temperature control device according to claim 1 wherein a plurality of cooling gas injecting means is vertically arranged in the temperature control tower.

6. A temperature control device according to claim 1 wherein the temperature control tower has at least two extended step parts extended in diameter toward the lower side.

7. A temperature control device according to claim 6 wherein the cooling gas injecting means are provided on the extended step parts.

8. A temperature control device according to claim 1 wherein the cooling gas injecting means is arranged in the direction of injecting the cooling gas obliquely downward to the inner wall of the temperature control tower so that the cooling gas forms a downward whirling gas flow laid along the inner wall of the temperature control tower.

9. A temperature control device according to claim 7 wherein the cooling gas injecting means provided on at least two extended step parts are constituted so as to inject the cooling gas from the cooling gas injecting means provided on the upper extended step part in the larger quantity than from the cooling gas injecting means provided on the lower extended stepped part.

10. A temperature control device according to claim 1 which further comprises a cooling water spray control means for regulating the spray quantity of the cooling water and a cooling gas injection control means for regulating the injection quantity of the cooling gas so that the quantity and temperature of the exhaust gas to be discharged with temperature control are constant.

11. A temperature control device according to claim 1 which further comprises a cooling water spray control means for regulating the spray quantity of the cooling water and a cooling gas injection control means for regulating the injection quantity of the cooling gas so that the temperature and moisture content of the exhaust gas to be discharged with temperature control are constant.

12. A temperature control device according to claim 1 wherein the discharge gas inlet duct is formed in a reverse V-bent shape between the high-temperature gas generating source and the temperature control tower.

13. A temperature control device according to claim 1 wherein the high-temperature gas generating source is a reduced metal manufacturing apparatus for manufacturing reduced iron by starting from a carbon reducing agent and an oxidized metal or a waste containing the oxidized metal and performing reduction or reduction and melting at a high temperature.

14. A temperature control device having a temperature control tower for controlling a blown high-temperature exhaust gas to a proper temperature and discharging the temperature-controlled exhaust gas, the temperature control tower comprising a cooling water spray means for spraying cooling water to about the center of the gas flow of the high-temperature exhaust gas and a cooling gas injecting means for injecting cooling gas along an inner wall of the temperature control tower.

15. A temperature control method for high-temperature exhaust gas comprising:

blowing a high-temperature exhaust gas discharged from a high-temperature gas generating source into a temperature control tower through an exhaust gas inlet duct;

spraying cooling water downward from an upper part of the temperature control tower toward about the center of the gas flow of the high-temperature exhaust gas;

injecting cooling gas obliquely downward so as to form a whirling gas flow along an inner wall of the temperature control tower; and discharging the exhaust gas controlled to a proper temperature from a lower discharge duct.

16. A temperature control method for high-temperature exhaust gas according to claim 15 wherein the temperature control tower comprises at least two extended step parts extended in diameter toward the lower side, the cooling gas is injected from an upper step side of the extended step parts, and the cooling gas is also injected from a lower step side, so that the quantity of the cooling gas is larger on the upper step side of the extended stepped parts than on the lower step side.

17. A temperature control method for high-temperature exhaust gas according to claim 15 wherein the injection quantity of the cooling gas and the spray quantity of the cooling water are regulated so that the quantity and temperature of the temperature-controlled exhaust gas to be discharged from the lower discharge duct are constant.

18. A temperature control method for high-temperature exhaust gas according to claim 15 wherein the injection quantity of the cooling gas and the spray quantity of the cooling water are regulated so that the temperature and moisture content of the temperature-controlled exhaust gas to be discharged from the lower discharge duct are constant.

19. A temperature control method for high-temperature exhaust gas according to claim 15 wherein the high-temperature exhaust gas discharged from the high-temperature gas generating source is once ascended obliquely, then descended obliquely, and blown into the temperature control tower.

20. A temperature control method for high-temperature exhaust gas according to claim 15 wherein the high-temperature gas generating source is a reduced metal manufacturing apparatus for manufacturing reduced iron by starting from a carbon reducing agent and an oxidized metal or a waste containing the oxidized metal and performing reduction or reduction and melting at a high temperature.

21. (Amended) In a temperature control method for high-temperature exhaust gas comprising blowing a high-temperature exhaust gas discharged from a high-temperature gas generating source into a temperature control tower having at least two extended step parts extended in diameter toward a lower side from a gas blowing port provided in an upper part thereof through an exhaust gas inlet duct; temperature-controlling the blown high-temperature exhaust gas to a proper temperature; and discharging the high temperature exhaust gas from a lower discharge duct, cooling water being sprayed from the upper part of the temperature control tower to about the center of the gas flow of the high-temperature exhaust gas, cooling gas being injected obliquely downward from cooling gas injecting means provided on the upper step side of the extended step parts of the temperature control tower in the larger quantity than from cooling gas injecting means provided on the lower step side so as to form a whirling gas flow along an inner wall of the temperature control tower, and the injection quantity of the cooling gas and the spray quantity of the cooling water being regulated so that the quantity and temperature of the exhaust gas to be discharged with temperature control from the lower discharge duct are constant.

* * * * *